US006125250A

United States Patent [19]

Kamio et al.

[11] Patent Number: 6,125,250

[45] Date of Patent: Sep. 26, 2000

[54] DEVELOPING DEVICE, DEVELOPING METHOD, AND AN IMAGE FORMING APPARATUS

[75] Inventors: Keiji Kamio; Yoshitaro Ishii, both of Hitachi; Shizuo Tsuruta; Masahiko Saito, both of Kitaibaraki; Tadashi Okano, Hitachi; Nobuo Suzuki, Hitachinaka; Yoshikatsu Shinonaga, Hitachi; Tetsuro Akatsu, Hitachinaka, all of Japan

[73] Assignee: Hitachi, Ltd., Tokyo, Japan

[21] Appl. No.: 09/182,221

[22] Filed: Oct. 30, 1998

[30] Foreign Application Priority Data

Oct. 30, 1997 [JP] Japan ..... 9-298185

[51] Int. Cl.[7] ..... G03G 21/00

[52] U.S. Cl. ..... 399/98; 399/284

[58] Field of Search ..... 399/98, 119, 222, 399/223, 252, 272–274, 281–284

[56] References Cited

U.S. PATENT DOCUMENTS 4,947,211 8/1990 Ono et al. ..... 399/281

5,317,370 5/1994 Kohyama et al. ..... 399/222

5,666,599 9/1997 Miyasaka et al. ..... 399/223

*Primary Examiner*—William Royer

*Assistant Examiner*—William A. Noe

*Attorney, Agent, or Firm*—Antonelli, Terry, Stout & Kraus, LLP

[57] ABSTRACT

When the upper case of the developing device is pushed from above, the upper case may be deformed producing a negatively activated pressure corresponding to the deformed volume of the case, thereby dispersing toner along with the air. When the developing device is mounted to or dismounted from the color image forming apparatus, the dispersed toner may fall out of the developing device. To prevent the toner from falling out of the developing device, the toner carrier and the limiting member for limiting the toner layer thickness are held in the developer case and a falling toner receiver is formed which is recessed in the developer case in the longitudinal and widthwise directions of the toner carrier and the limiting member for limiting the toner layer thickness. The falling toner is collected in the receiver, preventing the device from being contaminated with the falling toner and facilitating the cleaning of the device.

8 Claims, 4 Drawing Sheets

DEVELOPING DEVICE, DEVELOPING METHOD, AND AN IMAGE FORMING APPARATUS

BACKGROUND OF THE INVENTION

The present invention relates to a developing device, a developing method and an image forming apparatus.

First, a conventional developing device will be described in which a toner carrier is rotatably supported on a housing of the developing device. Further, a limiting member for limiting the thickness of a toner layer on the toner carrier is disposed so as to face the toner carrier. The limiting member for limiting the toner layer thickness forms the toner into a thin layer over the surface of the toner carrier. This limiting member comprises a rubber holding plate and a frictional limiting plate, such as a rubber plate, attached to the front end of the rubber holding plate. The holding member of the limiting member is secured to the housing by screws fitted into threaded holes in the housing, so that the frictional limiting plate comes into contact with the toner carrier.

Japanese Patent Laid-open No. 309080/1989 discloses a construction in which the toner carrier is rotatably supported on the housing by a support shaft, and in which the limiting member for limiting the toner layer thickness is positioned by taking the support shaft of the toner carrier as a reference. Japanese Patent Laid-Open No. 89869/1980 discloses a means for connecting together and supporting a toner carrier and a limiting member for limiting the developer layer thickness and defines the linear expansion coefficients necessary to improve the positioning precision of these elements.

Conventional developing devices incorporate various provisions to enable the toner carrier and the limiting member for limiting the toner layer thickness to be positioned precisely to form a thin layer uniformly. They also include a variety of improvements to deal with leakage of toner from the developer case. There has been a demand in recent years for further uniformity in image quality to enhance the image quality and the resolution of the developing device. This in turn requires improved performances of the toner carrier and the limiting member for limiting the toner layer thickness and further improvements in the measures taken to prevent toner leakage.

Conventional developing devices have both the toner carrier and the limiting member for limiting the toner layer thickness secured to the housing by a support plate in their final configuration.

In such a developing device, the toner in the form of fine powder is sealed in the housing. To prevent leakage of the toner to the outside of the housing, the upper and lower cases of the housing need to be closely held together. For this purpose, the upper and lower cases of the housing are fused together by ultrasonic welding to keep the housing airtight. Alternatively, a packing is used when the upper and the lower cases are hermetically held together by screws.

In these cases, the portion, where the limiting members for limiting the toner carrier and the toner layer thicknesses are secured to the housing through a support plate or the like, is formed with an opening. Therefore, when the upper case is pushed from above, the case may be deformed, producing a negatively activated pressure corresponding to the deformed volume of the case, thereby sending toner flying along with air entering from the opening where the limiting members for limiting the toner carrier and the toner layer thicknesses are secured to the housing through the support plate. Then, when the developing device is mounted to or dismounted from the color image forming apparatus, the dispersed toner may fall out of the device. Also, during image development, the toner may fall from the toner carrier and the limiting member for limiting the toner layer thickness due to the rotation of the parts.

SUMMARY OF THE INVENTION

The object of the present invention is to provide a developing device which is capable of stably forming a uniform, thin toner layer with a predetermined thickness on the toner carrier over a long period of time, and to provide a simple construction that improves the maintainability when handling the developing device.

To achieve the above object, the present invention provides a falling toner receiver that solves the above-mentioned problem of scattered toner. More specifically, in a developing device which includes a toner or fine coloring powder, a toner carrier, and a limiting member for limiting the thickness of a toner layer by pressing against the toner carrier to electrically charge the toner by friction and to form a thin toner layer on the toner carrier, the toner carrier formed with the thin toner layer is rotated to move the thin toner layer to a position facing a latent image holding means on which an electrostatic latent image is formed, in order to make the electrostatic latent image visible. The toner carrier and the limiting member for limiting the toner layer thickness are held in a developer case, and a falling toner receiver, which is recessed in the longitudinal and widthwise directions of the toner carrier, and the limiting member for the toner layer thickness is removably provided in the developer case.

With this construction, the toner that has fallen from the toner carrier and from the limiting member for limiting the toner layer thickness and which may be scattered by air entering the opening in the housing is collected in the falling toner receiver, thus preventing contamination from the falling toner.

DETAILED DESCRIPTION OF THE INVENTION

One embodiment of this invention will be described with reference to FIGS. 1 to 4.

Figure 1:
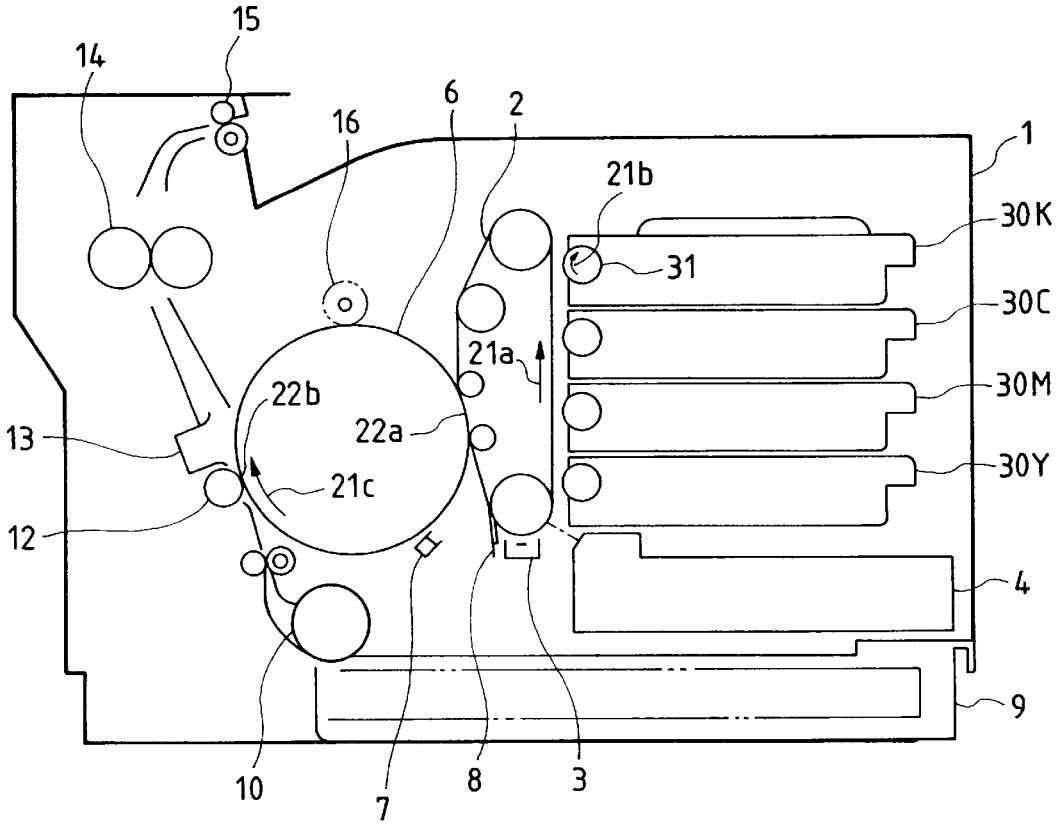
FIG. 1 is a vertical cross section of a color image forming apparatus representing one embodiment of this invention.

FIG. 1 is a cross section of a small color image forming apparatus according to this invention. This color image forming apparatus is constructed of a frame (outer frame) 1, in which an elongated photosensitive belt 2, forming a latent image holding means, is arranged vertically. On the left side of the photosensitive belt 2, as seen in the figure, there are installed a transfer drum 6 representing an intermediate transfer body, a transfer device 12, a recording medium feeding device 10 and a fixing device 14.

On the right side, as seen in the figure, there are arranged four developing devices 30Y, 30M, 30C, 30K loaded with four different color toners, respectively. Below the developing device 30Y, there is arranged an aligner 4 that forms a latent image on the photosensitive belt 2. A paper feed cassette 9 for holding recording media is located below the aligner 4.

Around the transfer drum 6, there are arranged a transfer device 12, a recording medium peeling device 13 and an intermediate transfer body cleaning device 16. Arranged around the photosensitive belt 2, there are a charging device 3, a residual image removing device 7 and a photosensitive body cleaning device 8. The photosensitive belt 2, which operates as a latent image holding means, is driven in the direction of arrow 21*a* by a drive unit which is not shown.

First, a photosensitive layer of the driven photosensitive belt 2 is electrically charged uniformly by the charging device 3. Next, the electrically charged surface is exposed with image and character information in dots from a personal computer or an image scanner by the aligner 4 to form an electrostatic latent image on the photosensitive belt 2.

Then, the electrostatic latent image on the photosensitive belt 2 is developed by one of the developing devices 30Y, 30M, 30C, 30K and is made visible as a toner image, before being sent to a first transfer position 22*a*. The photosensitive belt 2 is given an electrostatic potential by a power supply not shown and the transfer drum 6 is connected to ground. Hence, at the first transfer position 22*a* the potential difference causes the toner image to be transferred from the photosensitive belt 2 onto the transfer drum 6.

After passing the first transfer position 22*a,* the photosensitive belt 2 is cleared of the electrostatic latent image by light emitted from the residual image removing device 7. This reduces the surface potential of the photosensitive belt 2 below a predetermined level.

After this, the residual toner remaining on the photosensitive belt 2 that was not transferred during the first transfer operation is removed by the photosensitive body cleaning device 8 so that the photosensitive belt 2 is now ready to form a next toner image. The one-cycle operation described above is performed successively for each of the developing devices 30Y, 30M, 30C, 30K in synchronism with one rotation of the transfer drum 6 to form a plural-color toner image consisting of a plurality of superimposed single-color toner images on the transfer drum 6. At the same time, a recording medium such as paper or a OHP sheet, is fed to a second transfer position 22*b* at a correct timing by the feeding device 10. As a result, a single-color or plural-color toner image on the transfer drum 6 is transferred onto the recording medium by the action of the transfer device 12.

After the toner image has been transferred onto the recording medium, the recording medium is peeled off from the transfer drum 6 by the recording medium peeling device 13. Further, the toner on the recording medium is subjected to solvent fixing by the fixing device 14, after which the recording medium is discharged onto an upper surface of the apparatus by a paper discharge device 15. After the image transfer onto the recording medium, the residual toner remaining on the transfer drum 6 is cleared by the intermediate transfer body cleaning device 16. Now, the next toner images can be superimposed on the drum.

By making the recording medium transport path from feeding to discharging as simple as possible and by increasing the radius of curvature of the transport path as much as possible, paper jamming in the transport path can be prevented and the reliability of the apparatus can be improved. This enables the paper jamming to be dealt with easily and also allows the apparatus to handle a variety of kinds of recording media, including cardboard.

In this embodiment, the recording medium transport path is formed in a substantially arcuate path, and the transfer drum 6, the photosensitive belt 2, the developing devices 30Y, 30M, 30C, 30K and the aligner 4 are arranged inside the recording medium transport path. Taking advantage of this arrangement, the apparatus makes effective use of space, thereby reducing its size, has a simplified transport path, and adopts a configuration in which the recording medium is discharged with the printed surface facing down.

With the above-described arrangement, the transport path can be simplified, and almost all units are located on the inside of the apparatus. Because the transport path is close to the apparatus frame (outer frame) and is easily accessed, paper jamming can be handled easily. Discharging the recording media face-down offers the advantage of being able to stack the recording media, as they are discharged, in the order of printing when viewed from the printed side.

Forming the photosensitive body in a belt-like structure allows the plural-color developing devices 30 of almost the same shape to be arranged with their operative end on the same plane as the photosensitive belt. Further, there is no need to provide a mechanism for changing the developing device according to the color to be developed. Nor is it necessary to differentiate the shape among the developing devices according to color. This results in reductions in size and cost. Because the photosensitive belt 2 is an elongate belt arranged vertically, the space occupied can be made smaller than when it is arranged otherwise, which in turn contributes to a reduction in the size of the body.

When the recording medium is transported from the lower part of the apparatus toward the upper part, the transfer drum 6 rotates in the direction of arrow 21*c*. At the same time, the photosensitive belt 2 rotates in the direction of arrow 21*a*. Hence, at their contact points they work together in the same forward direction, thereby realizing a construction that has a high development efficiency and few problems, such as vibrations.

The transfer drum 6 may be made to rotate in accordance with rotation of the photosensitive belt 2 to reduce color misregistration. In this case, a reverse rotation development system is used in which a toner carrier 31 is rotated in the direction of arrow 21*b* (the toner carrier is rotated from the bottom toward the top on the photosensitive belt side). This allows the photosensitive belt 2 and the toner carrier 31 to be operated in the forward direction, improving the development efficiency and reducing such problems as vibrations.

Figure 2:
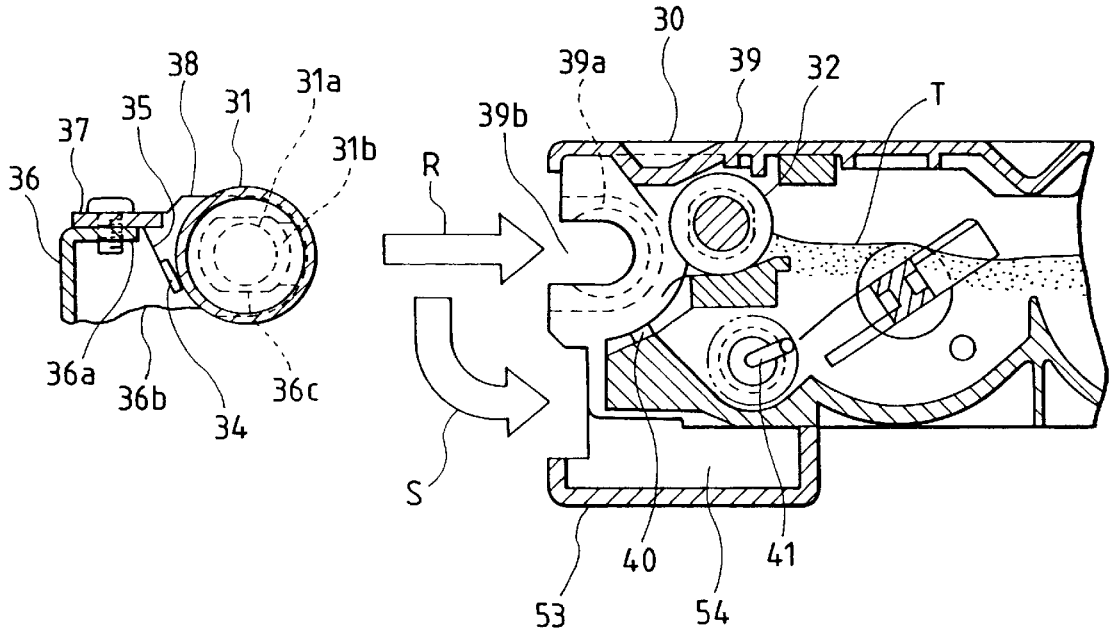
FIG. 2 is a cross section showing an essential portion of the developing device according to this invention.
Figure 3:
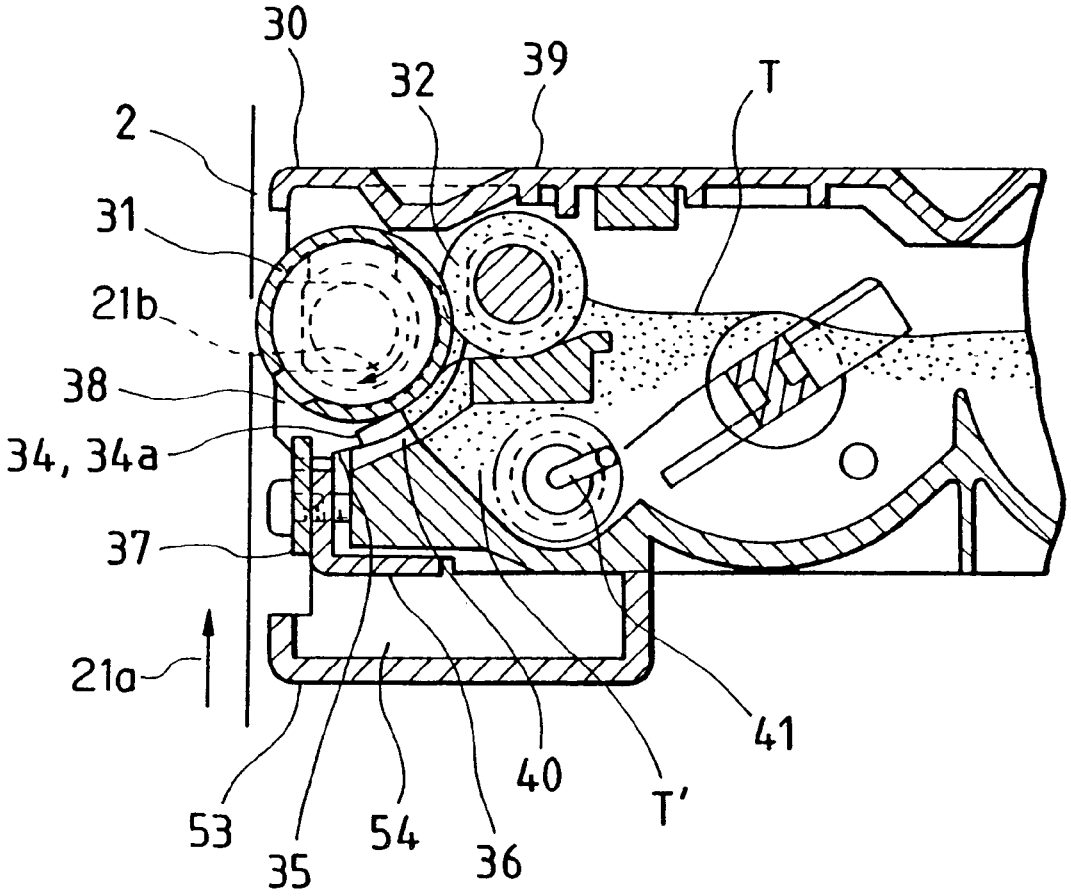
FIG. 3 is a vertical cross section of the toner carrier unit and housing of the developing device according to this invention.
Figure 4:
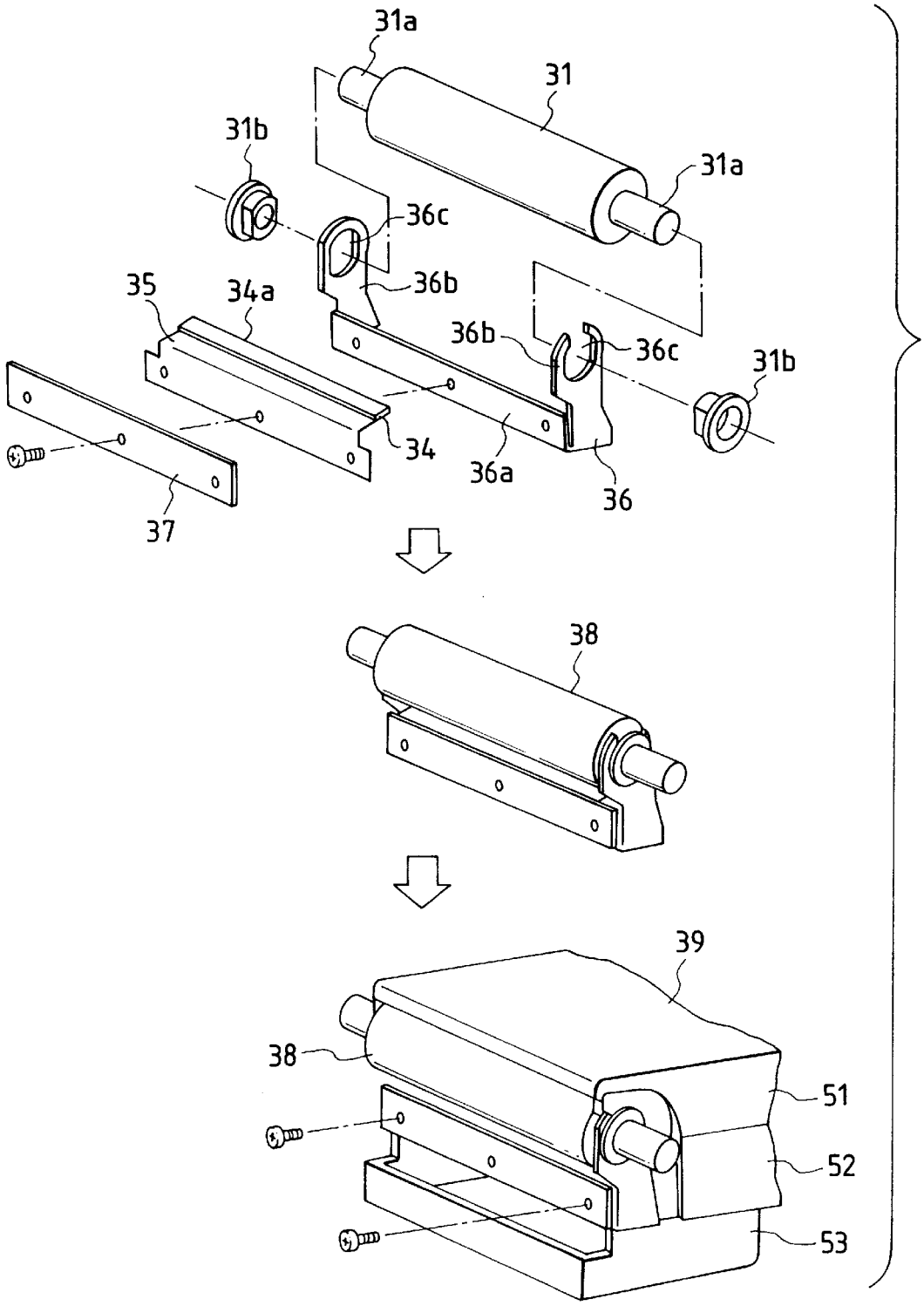
FIG. 4 is an exploded perspective view showing the assembly and construction of the toner carrier unit and housing of the developing device as one embodiment of this invention.

FIGS. 2, 3 and 4 show one embodiment of the developing device 30 according to this invention. The photosensitive belt 2 is driven from the bottom toward the top in the direction of arrow 21*a*. The toner carrier 31 of the developing device 30 is either in contact with or is spaced about 0.1–0.3 mm from the photosensitive belt 2. The toner carrier 31 is driven in the direction of arrow 21*b*. The toner carrier 31 is made of a conductor, such as aluminum or stainless steel, or a conductive rubber.

Arranged around the toner carrier 31 are a toner supply roller 32 and a limiting member 34 for limiting the thickness of the toner layer carried on the toner carrier 31. The limiting member 34 is pressed against the toner carrier 31 with an appropriate pressure by a pressure applying means 35. The pressure applying means 35 is formed as a leaf spring which is made of a thin plate of stainless steel or phosphor bronze. A frictional limiting plate 34*a* of the limiting member 34 may be made by bonding a rubber plate (urethane rubber, silicone rubber, etc.) to the leaf spring of the pressure means 35. It is also possible to extend the leaf spring of the pressure applying means 35 to directly contact the toner carrier 31. The limiting member 34 is clamped between a retainer plate 37 and a holding portion 36*a* of the holding member 36 and is secured to the holding portion 36*a*. The holding member 36 has support portions 36*b* for the toner carrier 31 on both sides. A toner carrier support shaft 31*a* is fitted through bearings 31*b* into opening portions 36*c* of the support portions 36*b*. The toner carrier 31 and the limiting member 34 are held together by the holding member 36 to form a toner carrier unit 38.

The holding member 36 and the support portions 36*b* for the toner carrier 31 are preferably formed as a single part. On the other hand, they may be made in separate pieces and assembled into one part. Forming them in one piece reduces assembly errors. They are preferably made of a metal plate with as small a difference in linear expansion coefficient as possible from the pressure applying means 35 to prevent deformation due to linear expansion coefficient differences.

The housing 39 of the developing device 30 is provided with a support portion 39*a* for the bearings 31*b* of the toner carrier unit 38 and with an opening portion 39*b* to allow engagement and disengagement of the bearings 31*b*, so that the integrally assembled toner carrier unit 38 can be attached to or detached from the housing 39. Further, the housing 39 is so constructed as to allow mounting and dismounting of the toner carrier unit 38 without having to first remove a cover or the like.

The toner carrier unit 38 is inserted in the direction of arrow R in FIG. 2 and then rotated in the direction of arrow S to mount the toner carrier unit 38 to the housing 39, as shown in FIG. 3.

FIG. 4 shows the detailed manner of assembly and the construction of the toner carrier unit 38. As described above, the limiting member 34 for limiting the toner layer thickness is clamped between the retainer plate 37 and the holding portion 36*a* of the holding member 36 and is secured to the holding portion 36*a* by screws. The toner carrier 31 has its toner carrier support shaft 31*a* fitted through the bearings 31*b* into the support portions 36*b* at both sides of the holding member 36 to form the toner carrier unit 38.

As shown in FIG. 2, the toner carrier unit 38 is inserted into the opening 39*b* of the housing 39 in the direction of arrow R with the flat portions of the bearings 31*b* aligned with the corresponding parts of the opening 39*b*, and the unit is then rotated in the direction of arrow S to engage the cylindrical parts of the bearings 31*b* with the support portion 39*a* of the housing 39. Finally, screws are fastened to fix the toner carrier unit 38 to the housing, providing a completely assembled structure of the developing device 30. When the toner carrier unit 38 is mounted to the housing 39 of the developing device 30, a toner seal member 40 is provided at a position corresponding to the back of the limiting member 34 for limiting the toner layer thickness.

The toner seal member 40 may be made of a foamed sponge, an elastic member, such as a rubber plate, or a sheet-like thin plate. Further, a toner scrape-up member 41 is provided to prevent the toner from remaining stagnant near the limiting member 34.

The developing device 30 with the above construction operates as follows. The toner T adhering to the toner supply roller 32, which is rotatably arranged by the side of and in contact with the toner carrier 31, is supplied to the toner carrier 31 and clings to it.

The pressure applying means 35, provided downstream of the toner supply to the toner supply roller 32, applies a contact pressure to the toner carrier 31 by pressing the frictional limiting plate 34*a* of the limiting member 34 against the toner carrier 31 with a predetermined pressure to form a thin layer of toner on the carrier surface. The excess toner T (oversupplied toner) that was blocked by the limiting member 34 falls below the layer thickness limiting plate 34*a* and is received in a falling toner receiver provided below and adjacent to the limiting member 34 and the toner carrier 31.

Then, the excess toner T is scraped out by the rotatable toner scrape-up member 41, so that no excess toner T remains stagnant near the limiting member 34. Therefore, it is possible to stably form a thin toner layer on the carrier surface at all times and apply an appropriate electrostatic charge to the toner. In a 10,000-sheet print test using this developing device, it was verified that a toner thickness of $0.42 \pm 0.03$ mg/cm$^2$ and an electrostatic charge of 20–30 $\mu$C/g were able to be achieved stably for long periods.

The toner carrier 31 and the limiting member 34 are supported together by the holding member 36. By controlling the precision of the parts of the holding member 36 to a high level, an accurate positioning of the toner carrier and the limiting member becomes possible. This in turn enables stable formation of a uniform, thin toner layer, improves the uniformity of images, and enhances the image quality and resolution. Because the toner carrier 31 and the limiting member 34 are supported together by the holding member 36, the positioning of the toner carrier 31 and the limiting member 34 is determined by the holding member 36. Therefore, accurate positioning does not require a high precision in the manufacture and assembly of the housing 39, and distortions or other anomalies that are caused by errors during assembly are small.

In the conventional developing devices, the positioning of the toner carrier and the limiting member for limiting the toner layer thickness is done by the housing, and thus a high precision is required in the manufacture of the housing. For this reason, an expensive resin that enables high precision molding must be used. Furthermore, jigs have been used during assembly to realize precise positioning.

This embodiment, however, can offer a sufficient level of precision with a common resin material. During assembly, only a single part, the holding member 36, needs to be controlled to a high precision, which has resulted in reduced assembly time and cost.

In the figures, the housing 39 comprises an upper case 51 and a lower case 52, and a recess 54 is also provided in a part of the housing 39 to form another falling toner receiver 53 which is spaced from the toner carrier 31 and limiting member 34. In this construction, toner that is scattered from the toner carrier 31 or the limiting member 34 when the air is moved inside the housing 39 as the upper case 51 is depressed, or toner which falls due to the rotation of the parts, is collected in this toner receiver 53. This prevents the device from being contaminated with falling toner.

As described above, a developing device can be provided which can stably form a uniform thin toner layer with a predetermined thickness on the toner carrier over a long period. At the same time, this device can prevent the toner from escaping out of the developing device, rendering the cleaning of the device easy. In other words, a developing device that allows easy maintenance can be realized with a simple, small-sized, light-weight, and inexpensive construction.

What is claimed is:

1. A developing device comprising:

a toner carrier to carry toner;

a limiting member for limiting the thickness of a toner layer on said toner carrier and which is pressed against the toner carrier to electrically charge the toner by friction and to form a thin toner layer on the toner carrier; and first and second falling toner receivers each provided below at least one of the toner carrier and the limiting member and spaced from one another;

wherein the toner carrier on which the thin toner layer is formed is rotated to carry the thin toner layer to a position facing a latent image holder on which an electrostatic latent image is formed, in order to make the electrostatic latent image visible.

2. A developing device according to claim 1, wherein each of the first and second falling toner receivers is provided below the toner carrier and the limiting member.

3. A developing device according to claim 2, wherein the toner carrier and the limiting member for limiting the toner layer thickness are held in a developer case.

4. A developing device according to claim 2, wherein at least one of the first and second falling toner receivers has a greater extent than the toner carrier and the limiting member in at least one of longitudinal and widthwise directions of the toner carrier and the limiting member.

5. A developing device according to claim 1, further comprising a toner supply roller for supplying the toner to the toner carrier, wherein at least one of the first and second falling toner receivers extends underneath the toner supply roller.

6. A developing method comprising the steps of:

electrically charging toner by friction to form a thin toner layer on a carrier; and carrying the thin toner layer to a position facing an electrostatic latent image to make the electrostatic latent image visible; and collecting falling toner in at least one of first and second receiving members spaced from one another and arranged below where the thin toner layer is formed.

7. An image forming apparatus comprising:

a developing device using a toner to develop an electrostatic latent image formed on a surface of a recording material;

a transfer device to transfer the developed image onto paper; and a fixing device to fix the transferred image; wherein the developing device comprises a toner carrier and a limiting member for limiting the thickness of a toner layer on the toner carrier and which is pressed against the toner carrier to electrically charge the toner by friction and to form a thin toner layer on the toner carrier; the toner carrier on which the thin toner layer is formed is rotated to carry the thin toner layer to a position facing a latent image holding means on which an electrostatic latent image is formed, in order to make the electrostatic latent image visible; the toner carrier and the toner layer thickness limiting member are held in a developer case; and first and second falling toner receivers spaced from one another and provided below the toner carrier and the limiting member.

8. An image forming apparatus according to claim 7, further comprising a plurality of developing devices to develop different colors, wherein the developing devices each have first and second falling toner receivers and are arranged so that they are vertically stacked.

* * * * *